US006030240A

United States Patent [19]

Duff

[11] Patent Number: 6,030,240

[45] Date of Patent: Feb. 29, 2000

[54] COAXIAL CONNECTORS

[75] Inventor: Michael Duff, Reading, United Kingdom

[73] Assignee: ITT Manufacturing Enterprises, Inc., Wilmington, Del.

[21] Appl. No.: 09/073,713

[22] Filed: May 6, 1998

[51] Int. Cl.[7] ..... H01R 29/00

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 3,946,390 | 3/1976 | Alexander et al. | 439/188 |
| 5,322,453 | 6/1994 | Resnick et al. | 439/581 |
| 5,625,177 | 4/1997 | Yukinori et al. | 439/188 |
| 5,789,912 | 8/1998 | Yukinori et al. | 439/188 |

FOREIGN PATENT DOCUMENTS

| | | |
|---|---|---|
| 0 393 670 A2 | 4/1990 | European Pat. Off. . |
| 0 563 996 A2 | 4/1993 | European Pat. Off. . |
| 0 678749 A2 | 10/1996 | European Pat. Off. . |
| 152191 | 1/1936 | United Kingdom . |
| 794141 | 1/1956 | United Kingdom . |
| 2 266 627 | 11/1993 | United Kingdom . |
| 2 282 715 | 12/1995 | United Kingdom . |
| WO81/01082 | 4/1981 | WIPO . |
| WO 98/31078 | 7/1998 | WIPO . |

OTHER PUBLICATIONS

GB 1350/46–[Roesch]–Publication laid open for Inspection on May 3, 1946.

*Primary Examiner*—Steven L. Stephan
*Assistant Examiner*—T C Patel
*Attorney, Agent, or Firm*—Thomas L. Peterson

[57] ABSTRACT

A coaxial connector has a housing (20) and a contact (10) is provided in the housing for electrical connection to a contact of a mateable connector. The contact 10 is resiliently deflectable in the mating direction upon mating with a suitable connector.

3 Claims, 5 Drawing Sheets

FIG. 3
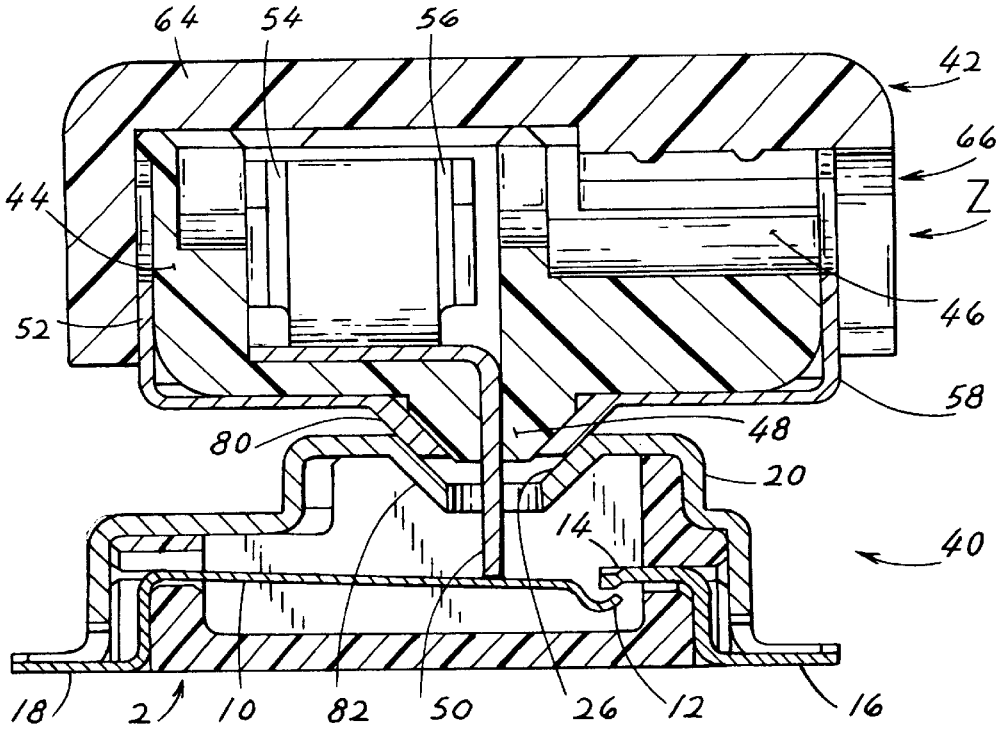
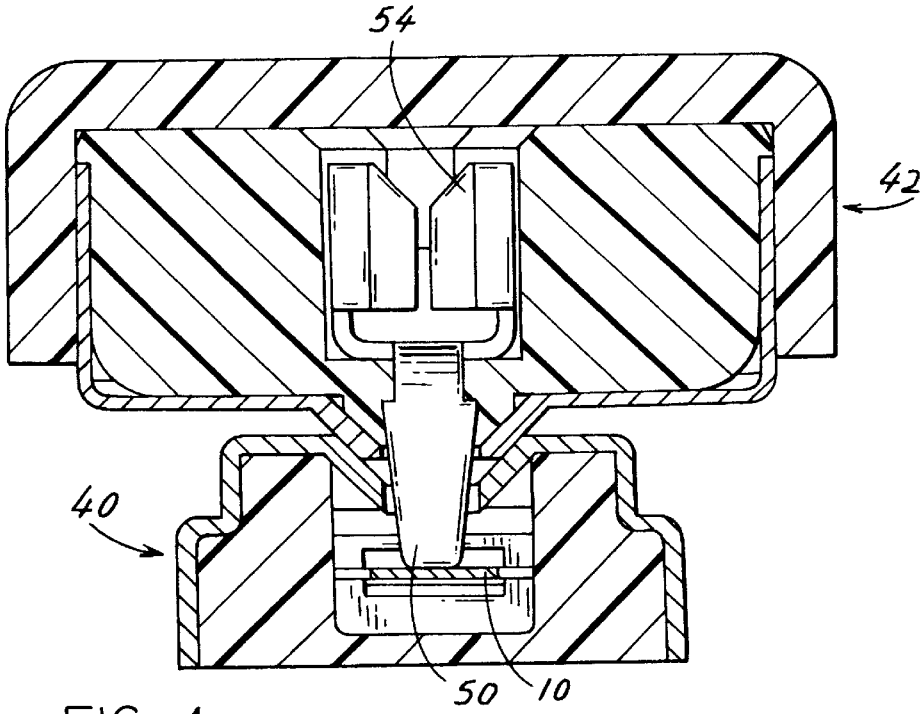
FIG. 4

COAXIAL CONNECTORS

BACKGROUND OF THE INVENTION

This invention relates to coaxial connectors and more particularly but not solely to such connectors suitable for use with mobile telephones.

Coaxial connectors are well known for connecting coaxial cables to electrical equipment. Conventional devices employ male and female connectors the female of which is normally mounted on the equipment and the male of which is normally mounted on the end of the coaxial cables. Such connectors normally have on the female portion a contact for the central conductor which extends axially of the connector whilst the male connector has a projecting plug element again extending axially of the connector for connection to the central conductor of the cable. The two connectors are mated by a relative axial movement in line with the mating contacts. The disadvantage of such a construction is that the connectors have considerable length and if mounted in an equipment extended to a considerable depth within the equipment or alternatively project to a considerable extent outside of the equipment.

The present invention has been arrived at from as consideration of the requirements for such connectors in a mobile telephone where the telephone is to be adapted for use not only with its own internal aerial but with a substitute or external aerial such as might be provided on a vehicle. In such circumstances it is required to connect the substitute or external aerial to the mobile phone when located in the vehicle. It will be appreciated that mobile telephones are becoming smaller and more compact and this leads to a requirement for a coaxial connector of extremely compact form.

The present invention seeks to provide a connector configuration that is susceptible of miniaturisation which is particularly suitable for use with mobile telephones but which has applications to other equipments and to the provision of a cooperative connector combination and also a mobile telephone provided with such a connector or connector combination with the capability of automatic switching between internal and a substitute or external aerial.

SUMMARY OF THE INVENTION

According to the invention there is provided a coaxial connector having a housing and a contact in the housing for electrical connection to a contact of a mateable connector, which contact is resiliently deflectable in the mating direction upon mating with a suitable connector. The housing is preferably of metallic forming a screen for the contact, and an aperture in the housing permits access between the contact and the contact of a mating connector. The metallic housing in a region surrounding the aperture is preferably shaped for cooperative engagement with a complementary shaped housing of a mating connector. The shaping may be in the form of a recess, which may be of truncated conical cross section, for receipt of a complementary shaped projection of a mating connector.

The connector may be adapted for mounting on a printed circuit board by the provision of a terminal communicating with the housing and a terminal communicating with the contact, which terminals extend at one side of the housing. The terminals may extend in a radial direction relative to the mating direction and may be substantially coplanar.

The contact of the connector may be deflectable to actuate a switch so as to divert an electrical path through the connector as a result of mating with a suitable complementary connector. The switch may cause opening of an electrical path through the connector. The contact itself may have a switching contact which normally is closed with another contact to define a predetermined path through the connector but which is separated from the other switch contact upon mating with a suitable connector. The other switch contact may be provided with a terminal which extends on one side of the housing and may extend in a radial direction relative to the mating direction so as to be substantially coplanar with the other terminals.

A coaxial combination in accordance with the invention comprises a first connector as previously defined and a second connector mateable with the first connector by relative movement in a mating direction, the second connector having a housing and a contact which makes contact with and effects a resilient deflection of the contact of the first connector during the mating movement. The contact of the first connector may be an elongate finger and the contact of the second connector may comprise a projecting element. The projecting element may have an end within the housing which extends laterally. The second connector may comprise a cable support body mountable in the housing having an elongate recess extending transversely of the mating direction, for receiving the prepared end of a coaxial cable, and a closure retentively locatable on the housing, which recess has projecting insulation displacement connectors extending into the recess and adapted to connect to screen and centre conductor of the prepared cable which are urged into engagement therewith when the closure is fitted on the housing.

The invention also includes a mobile telephone having a switched connector as previously defined, provided in the path between the integral aerial of the telephone and the transmitter/receiver circuitry which is effective to disconnect the integral aerial as a result of mating with a suitable connector coupled to a substitute aerial.

The invention also includes a mobile telephone equipment having a connector combination as previously defined, wherein the first connector is provided on a mobile telephone phone and the second connector is provided on a vehicle coupled to a vehicle aerial, the coupling of the connectors being effective to disconnect the internal aerial and connect the external aerial. The second connector may be provided in a carrying cradle for the telephone such that first and second connectors are caused to interconnect by insertion of the telephone into the cradle.

In order that the invention and its various other preferred features may be understood more easily, some embodiments thereof will now be described, by way of example only, with reference to the drawings in which:

BRIEF DESCRIPTION OF THE DRAWINGS

FIG. 3 is a cross section taken along the X—X of FIG. 2, FIG. 4 is a cross section taken along the line Y—Y of FIG. 2.

DESCRIPTION OF PREFERRED EMBODIMENTS

Figure 1:
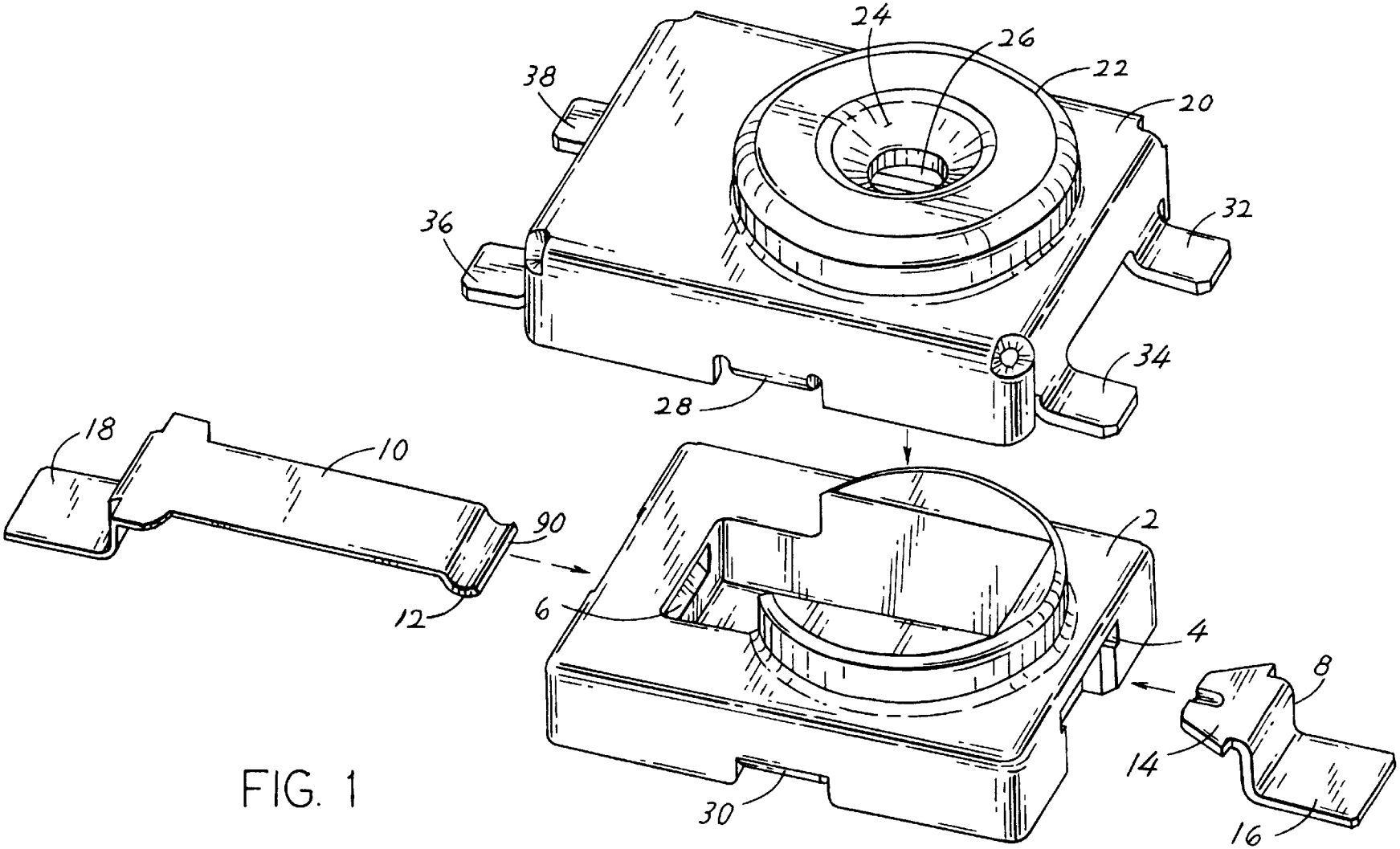
FIG. 1 is an exploded view of a coaxial connector constructed in accordance with the invention.

Referring now to FIG. 1 there is shown a first coaxial connector 40 having a body 2 moulded from a dielectric material and having slots 4 and 6 at opposite ends for receipt of sheet metal metal switch contact and terminating elements 8 and 10. The element 10 is in the form of an elongate finger and is formed of a resilient material for example beryllium copper. The element 10 is formed at one end with a curved contact end 12 which, after insertion of the element through the slot 6 makes contact with the end 14 of the element 8. The contact end 12 is bent to form a tip 90 that faces at least partially upward and that engages the stationary switch element 8. The opposite ends of the elements 8 and 10 are formed downwardly and outwardly to provide terminals 16 and 18 for electrical connection to the tracks of a printed circuit board by for example soldering. The connector has a metallic housing 20 which has a raised dome 22 with an inwardly extending recess 24 of preferably truncated conical form the end of the recess provides an aperture 26. The housing 20 fits on the body 2 and locks thereon by means of cooperating latching elements 28 and 30. The housing has four downwardly and outwardly extending terminals 32, 34, 36, 38 which when the housing is located on the body are coplanar with the terminals 16 and 18 and can be secured to the track of the printed circuit board.

Figure 2:
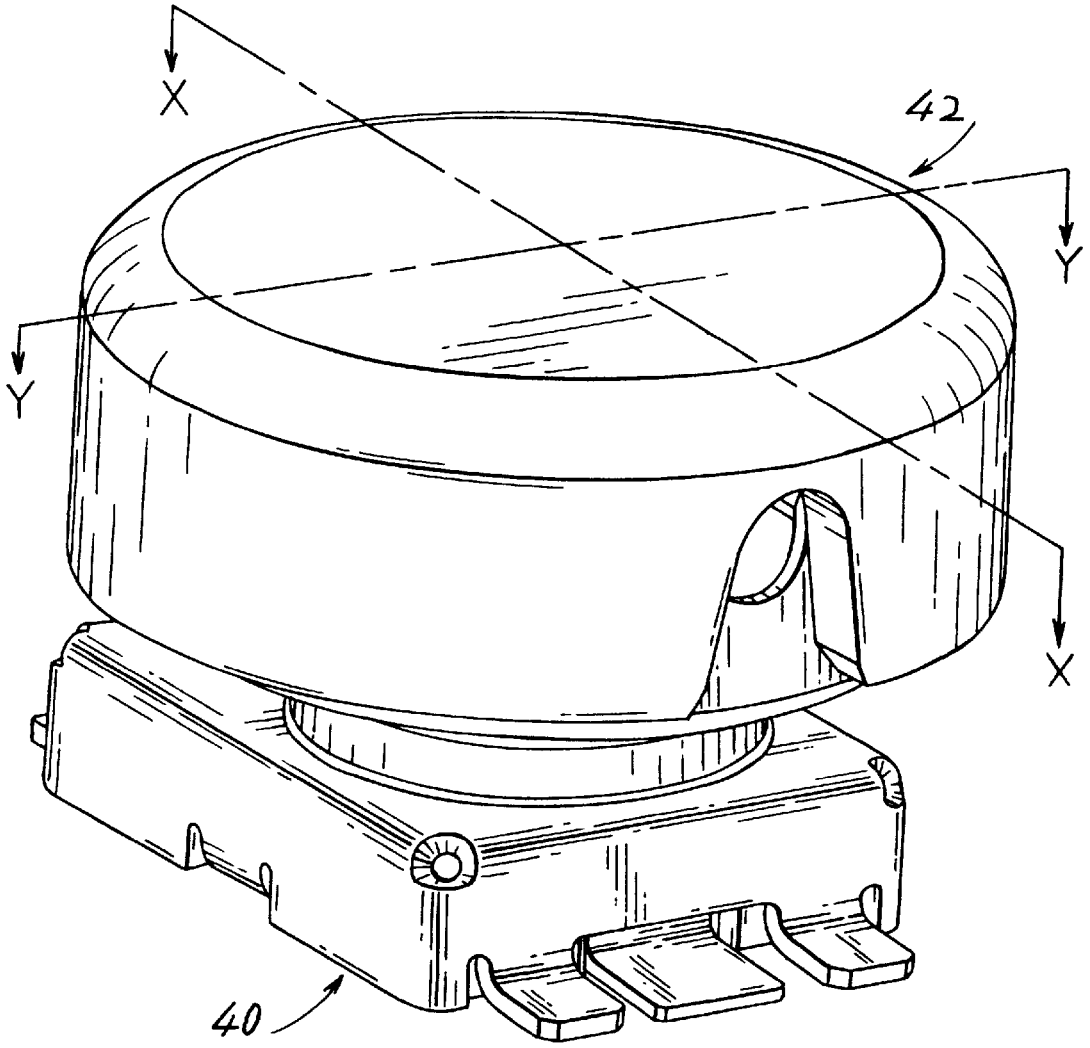
FIG. 2 is an isometric view showing the assembled connector of FIG. 1 together with a mated complimentary connector.
Figure 5:
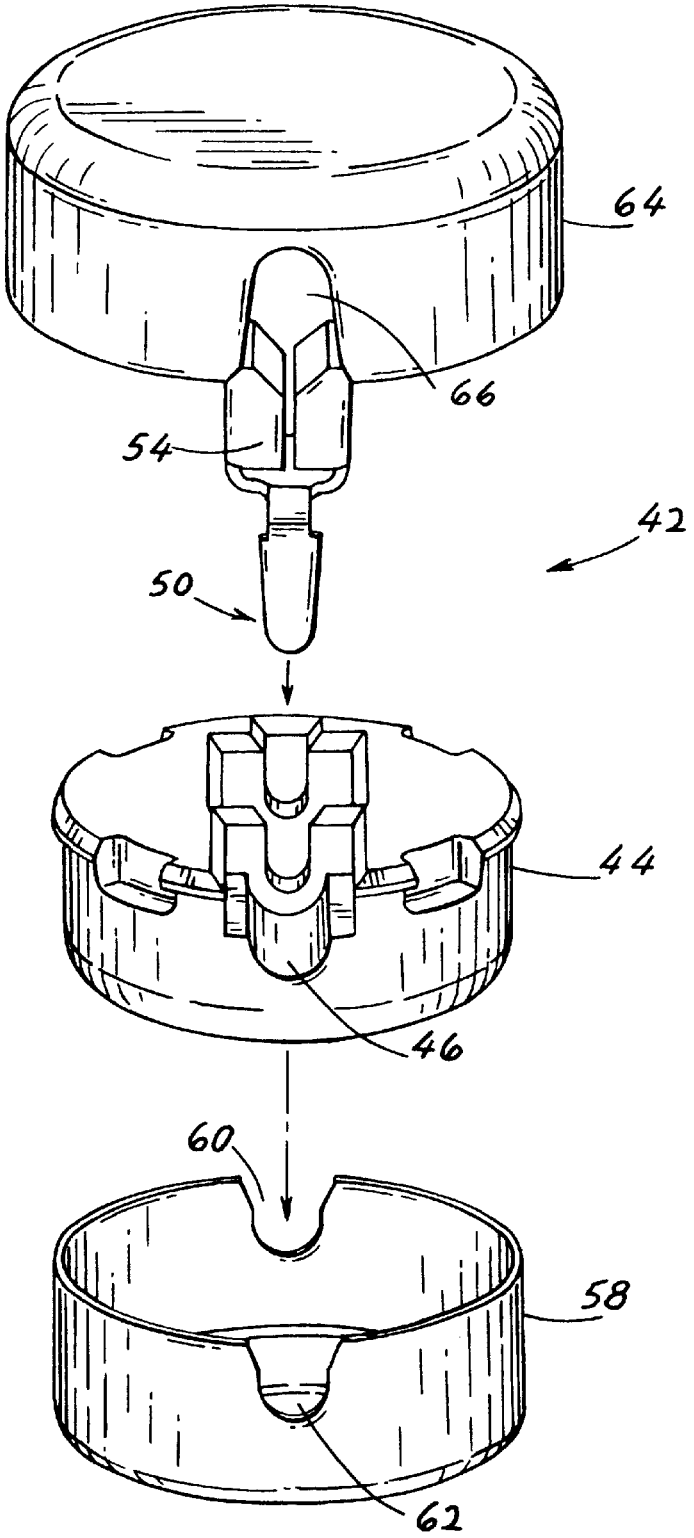
FIG. 5 is an exploded view of a connector which is mateable with the connector of FIG. 1 to form a coaxial connector combination in accordance with the invention.

Referring now to FIG. 2 there is shown the assembled connector of FIG. 1 shown generally as 40. A cooperating connector 42 is shown mated with the connector 40. The construction and mating of the two connectors is more easily seen from the drawings of FIGS. 2 and 3 which show cross sectional views through the mated assembly. In FIGS. 3 and 4 it can be seen that the second connector 42 comprises a moulded dielectric body 44 having an elongate recess 46 which is designed to receive the prepared end of a coaxial cable lying in the direction of the arrow Z. The body 44 has a frusto-conical projection 48 and an aperture therethrough through which there projects a contact 50. As shown in FIGS. 3 and 4, the contact 50 engages the switch contact and terminating element 10 and in the fully mated position deflects the contact such that the switch contact 12 separates from the end 14 forming the other contact of the switch. The contact 50 has an end 52 within the body which extends laterally and is provided with a pair of inclined insulation displacement connectors 54 and 56 for receiving the insulated inner conductor after stripping back of the outer screen. The body 44 is provided with a metallic housing 58 of shallow cylindrical form closed at one end except for an aperture which is shaped to conform with the conical projection 48. The metallic housing 58 of the second connector 42 forms a tapered mating part 80 that engages a tapered part 82 of the metallic housing 20 of the first connector 40. Oppositely disposed at the open edges of the shallow cylindrical housing 58 there are provided inwardly inclined slots 60 and 62 (FIG. 5) which are shaped to receive the insulated screen of a coaxial cable. A closure 64 of shallow cylindrical form, having one end closed, and sized to fit over the metallic housing 58 is provided with an aperture 66 on one side which permits passage of the insulated screen of a coaxial cable. In order to terminate a coaxial cable to the connector 42 the screen and outer insulator is stripped back to provide an exposed projecting insulated inner conductor. The end of the bare inner conductor is laid in the recess 46 in the body 44 such that the insulated inner conductor overlies the insulation displacement connectors 54 and 56 the body is placed in the housing 58 such that the insulated screen overlies one of the slots 60. The closure 64 is fitted over the housing 58 and pressed thereon until it snaps into latching engagement whereby the coaxial cable is forced into the insulation displacement connectors and terminates the cable such that the inner conductor is connected to the contact 50 and the screen is connected to the housing 58.

The switching action which opens the connection between terminal 16 and 18 upon mating of the two connectors is particularly suitable for use in mobile telephones. The connector is mounted on a printed circuit board in the telephone and extends through the back of the housing. The contact 16 is coupled with the integral aerial of the mobile telephone whilst the contact 18 is connected to the transmitter receiver circuitry. The coaxial cable terminated in the connector 42 is coupled with a substitute aerial for example the aerial of a vehicle. Upon mating of the connector 42 with the connector 40 the switch contacts are opened thereby disconnecting the integral aerial from the transmit/receive circuitry and the external aerial is connected to the transmit receive circuitry in its place.

Figure 6:
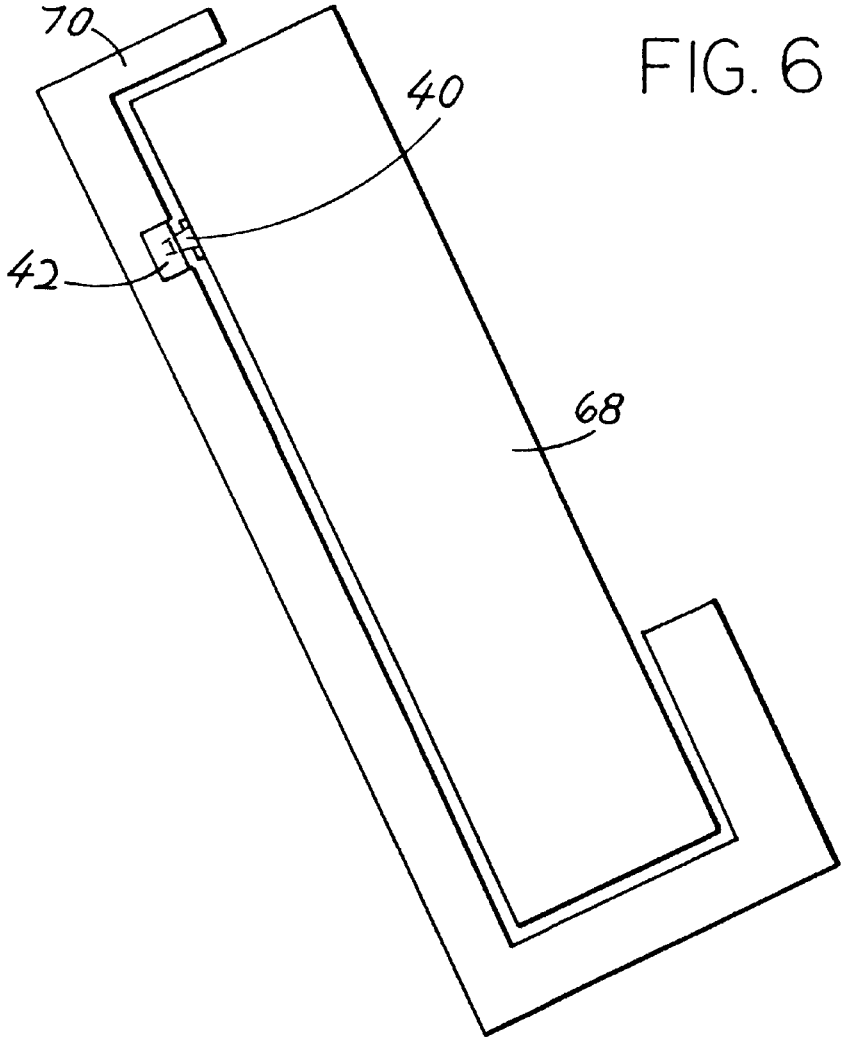
FIG. 6 is a diagrammatic view illustrating a mobile telephone equipment constructed in accordance with the invention and employing the connector combination of FIGS. 1 to 5.

A mobile telephone equipment in accordance with the invention is illustrated in FIG. 6 where a mobile telephone 68 is provided with a connector 40 and a cradle 70 for mounting in a vehicle. The equipment is provided with a connector 42 suitably disposed in the cradle such that the mobile telephone can be located in the cradle with the connectors 40 and 42 in mated disposition thereby providing switchover to connect to the aerial of a vehicle.

Figure 7:
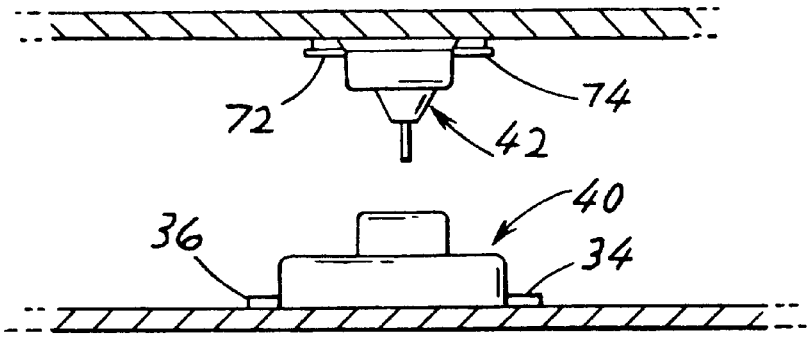
FIG. 7 is a diagrammatic view showing a mateable complementary connectors mounted each at a different printed circuit board permitting a coaxial coupling between boards.

Referring now to FIG. 7, instead of providing for termination of a coaxial cable in the connector 42, terminals 72 and 74 similar to terminals 16, 18 and 32 to 38 may be provided and bent to form coplanar terminals for connection to the tracks of another printed circuit board so that the two connectors can be employed to make coaxial connection between two printed circuit boards.

Although the embodiments described employ a switch contact 12 which is actuated upon mating by a suitable connector the invention also includes a non switching type connector which may have applications where for example it is required to couple an electrical signal into and out of an electrical equipment via a coaxial cable or to make an electrical communication between two board using a configuration similar to that illustrated in FIG. 7.

Although the projection 48 and the recess 24 into which it engages is illustrated as being frusto conical it will be appreciated that other shapings which permit location and good electrical interconnection could be employed for example the recess might be concave.

Although the terminals 16,18, 32 to 38 and 72 and 74 are shaped so that they are coplanar to permit surface mounting on the tracks of a printed circuit board it will be appreciated that they may be of alternative configuration for example they may extend to one side of the connector so that they can be plugged into holes provided in a board and may be secured by soldering to tracks on the opposite side.

Although the connector 42 for terminating a coaxial cable is shown to employ insulation displacement connectors as a quick and reliable method within the confines of a small package space, alternative means of termination may be employed for example traditional crimping or soldering can be employed.

The construction described enables the production of a switched RF connector within a very small and restricted package space. By placing the operating male contact at right angles to the female contact direct operation of the switch is made possible within a reduced thickness (3 millimeter) this enables an RF switch to be produced within a 10×8×4 millimeter envelope.

I claim:

1. A combination of first and second connectors wherein:

said first connector has a first body and a pair of switch elements mounted on said first body, including a stationary switch element and a deflectable switch element, with said deflectable switch element having an element end that is biased into engagement with said stationary switch element, with said first connector having a metallic housing with first walls, said first walls having an aperture lying in line with said deflectable switch element;

said second connector has a second body and a second metallic housing mounted on said second body and forming a body projection that fits into said aperture, said second connector including a second contact mounted on said second body and that projects beyond said second body to engage said deflectable switch element to deflect it out of engagement with said stationary switch element;

said first walls of said first metallic housing having a first tapered mating part;

said second metallic housing having a tapered projecting part that engages said tapered mating part of said first metallic housing.

2. The combination of in claim 1, including:

a telephone cradle with a telephone-holding recess, with said first connector mounted on said telephone cradle and said aperture opening into said telephone-holding recess;

a telephone which is nested in said cradle, with said second connector mounted on said telephone and with said tapered projecting part of said second metallic housing facewise engaging said tapered mating part of said first metallic housing.

3. The combination of in claim 1, wherein:

said stationary switch element has a contacting part that lies in a horizontal plane and that is engaged by said deflectable switch element;

said deflectable switch element is formed of sheet metal and has a part that lies in said horizontal plane and that has an end that is bent to form a tip that faces at least partially upward and that engages said contacting part of said stationary switch element.

* * * * *